US008067900B2

(12) United States Patent
Deixler et al.

(10) Patent No.: US 8,067,900 B2
(45) Date of Patent: Nov. 29, 2011

(54) ELECTRONIC DEVICE FOR DRIVING LED STRINGS

(75) Inventors: Peter Deixler, Eindhoven (NL); Gian Hoogzaad, Mook (NL)

(73) Assignee: NXP B.V., Eindhoven (NL)

( * ) Notice: Subject to any disclaimer, the term of this patent is extended or adjusted under 35 U.S.C. 154(b) by 271 days.

(21) Appl. No.: 12/517,245

(22) PCT Filed: Nov. 29, 2007

(86) PCT No.: PCT/IB2007/054842

§ 371 (c)(1),
(2), (4) Date: Jun. 2, 2009

(87) PCT Pub. No.: WO2008/068681

PCT Pub. Date: Jun. 12, 2008

(65) Prior Publication Data

US 2010/0019681 A1 Jan. 28, 2010

(30) Foreign Application Priority Data

Dec. 4, 2006 (EP) ..... 06125294

(51) Int. Cl.
*H05B 41/36* (2006.01)
*G09G 3/36* (2006.01)

(52) U.S. Cl. ..... 315/294; 315/297; 315/185 R; 315/193; 345/102; 345/82

(58) Field of Classification Search ..... 315/185 R, 315/186, 119, 224, 291, 294, 297, 307, 312; 345/46, 82, 102
See application file for complete search history.

(56) References Cited

U.S. PATENT DOCUMENTS

| | | | | |
|---|---|---|---|---|
| 5,767,822 | A * | 6/1998 | Hiroshi | 345/46 |
| 6,515,434 | B1 | 2/2003 | Biebl | |
| 6,717,604 | B2 * | 4/2004 | Nagumo | 347/237 |
| 7,560,677 | B2 * | 7/2009 | Lyons et al. | 250/205 |
| 7,800,566 | B2 * | 9/2010 | Ha et al. | 345/82 |
| 7,808,478 | B2 * | 10/2010 | Choi et al. | 345/158 |
| 2005/0212459 | A1 | 9/2005 | Patel et al. | |
| 2005/0243041 | A1 | 11/2005 | Vinn | |
| 2008/0100561 | A1 * | 5/2008 | Price et al. | 345/102 |
| 2008/0292344 | A1 * | 11/2008 | Nagumo | 399/51 |

* cited by examiner

*Primary Examiner* — Vibol Tan

(57) ABSTRACT

The present invention relates to an electronic device for driving at least a first channel and a second channel of light emitting diodes. The electronic device includes driving means having a first and a second driving portion for driving the first and the second channel of light emitting diodes separately, and configuration means for providing configurability of the driving means for using the driving means at least partially in a shared manner for more than one channel of light emitting diodes.

13 Claims, 8 Drawing Sheets

ELECTRONIC DEVICE FOR DRIVING LED STRINGS

FIELD OF THE INVENTION

The present invention relates to an electronic device for driving light emitting devices, more specifically to a driver arrangement for driving light emitting diodes. The invention further relates to a system comprising the electronic device and the light emitting diodes, and a method of driving the diodes.

BACKGROUND OF THE INVENTION

Light emitting devices, like light emitting diodes (LED) are becoming more and more popular to be used as substitutes for conventional light sources. The driving circuits used for the light emitting devices are pushed to increasing levels of integration. This aims to integrate all electronic components like power control, power delivery, microprocessor units for color control, sensor readout hardware, protocols for wired and wireless communication etc. Up to date applications for LEDs require a wide variety of flavors ranging from phosphor-converted white to RGB or RGBA. Multi-color arrangements require different independent channels in order to set amplitudes and pulse width modulated brightness levels independently for each color. Control of brightness and color is carried out by integrated NMOS or PMOS transistors (i.e. N-type and P-type metal oxide silicon transistors) being suitable to withstand high currents and high power levels. The transistors are used as switching devices or as linear devices to control the current through the LEDs. Accordingly, the chip size consumed by those integrated switches is considerably high. This results in a waist of unused functionality and chip area, if not all channels are used, or if the power rating limitation of one channel is exceeded by the application requirement.

SUMMARY OF THE INVENTION

It is an object of the present invention to provide an electronic device for driving light emitting diodes, which effectively uses the electronic components.

According to an aspect of the present invention an electronic device for driving at least a first channel and a second channel of light emitting diodes is presented, which includes a driving means having a first and a second driving portion for driving the first and the second channel of light emitting diodes separately, and configuration means for providing configurability of the driving means for using the driving means at least partially in a shared manner for more than one channel of light emitting diodes. The driving means include for example gate or bypass drivers and MOSFET transistors to be used as switching devices, or linear power transistor providing currents through the light emitting diodes. The drivers and transistors of the driving means are arranged in driving portions. Each of the driving portions is dedicated to drive one channel of LEDs. A channel relates typically to one or more strings of LEDs. The configuration means include control units, registers, multiplexers, or any other electronic device suitable to receive and provide configuration information and configurability for the electronic device. The configuration means may include switching mechanisms to switch electrical paths on and off, or to relocate control signals from one electrical path to another. The configuration means may also include control units to provide appropriate control signals for the driving portions, in particular the gate drivers and bypass drivers of the driving means. Further, the configuration means are adapted to receive respective sensing signals such as sensing voltages being representative of the currents through the light emitting diodes. Accordingly, the electronic device according to this aspect of the present invention is configurable to allow shared use of portions of the driving means. The shared use relates to situations, in which for example a single string of light emitting diodes should be driven by combined driving portions, in particular, by two or more power transistors or power switches in parallel or in series, wherein each transistor belongs to a different driving portion. Further, according to the present invention, a single gate driver or a single bypass driver may be configurable to be used for different or multiple power transistors. Multiple channels of LEDs may share a single driver or a single control unit, or both. According to the present invention, the electronic device, in particular the electronic circuitry provided in the electronic device, is adapted to be configurable to allow reuse of parts of the control units and the driving portions to provide an improved flexibility and applicability of the electronic components. The basic concept according to the present invention covers linear drivers including operational amplifiers as driving devices as well as switched mode driving circuitry, including pulse width modulation, drivers, and switches etc. for driving light emitting diodes in a switched mode. The concept of the present invention as set out above is particularly beneficial for integrated circuits where some or all of the above mentioned components are implemented on a single integrated device. As the area consumed by the driving devices, in particular the transistors used to supply the currents to the LEDs is considerably high, reuse of the components as suggested by the present invention may reduce the required chip area substantially. Another important advantage of the present invention relates to power efficiency. If two or more switches are used in parallel, the on resistance of the combined switches is reduced compared to a single switch. Further, the conduction losses ($I^2R$) are also reduced by this effect. The beneficial outcome of this situation is two-fold, in that power consumption is reduced and thermal dissipation is smaller. Reduced heat production entails an increased lifetime. Comparable characteristics may only be achieved by a prior art device having a single switch with twice the area (chip area) of a conventional single switch.

According to an aspect of the present invention, the configuration means include a first control unit being adapted to provide control signals for the first driving portion, and a second control unit being adapted to provide control signals for the second driving portion, wherein the first control unit is further configurable to provide control signals to the first and the second driving portion to enable the shared use of at least parts of the first and second driving portion. This aspect of the invention also relates to an enhanced configurability and an improved reuse of specific components of the electronic device for different applications. A specific first control unit, which is usually provided to control a single driving portion is enabled to drive at least parts of the first and the second driving portion. These parts may be the gate drivers or the switching means, or the power transistors. Further, the configuration means include means to disable the second control unit at least partially, if the first control unit is used to control the first and second driving portion. In addition to this aspect of the present invention, the first control unit is further adapted to receive a sensing signal from a first string of light emitting diodes, which is coupled to the first and second driving portions. The control units are enabled—by way of respective configuration means—to receive sensing signals being representative of different configurations of light emitting diodes. If, for example, a first control unit is adapted to receive a sensing signal from a single string of light emitting diodes, the present invention provides further configurability to the control unit such that the control unit is configurable to receive a sensing signal that is representative of multiple different sensing signals. These sensing signals may represent a current through a string of light emitting diodes, which is driven by a plurality of combined drivers. The concept of using the driving means at least partially in a shared manner allows using at least e.g. a control unit, a gate driver, a bypass driver, a switch, or a power transistor to be reused for different channels of light emitting diodes. Further, the electronic device is configured such that the driving portions, which are basically configured to drive each a single channel, can be used both, in parallel or in series, to drive a single channel, i.e. a single string or multiple strings in parallel with more current or a higher voltage than available from the driving devices of a single channel.

According to another aspect of the present invention, the driving means comprise a first switch and a second switch, and the configuration means are adapted to enable the combined use of the first and the second switch for one channel of light emitting diodes. For the linear drivers, the present invention provides that the driving means comprise a first power transistor and a second power transistor, and the configuration means are adapted to enable the combined use of the first power transistor and the second power transistor for one channel of light emitting diodes. This aspect of the present invention includes serial and parallel coupling of the driving devices.

Still another aspect of the present invention provides that the electronic device includes a first control unit and a second control unit, each of which is dedicated to a specific driving portion of the electronic device. At least one of the first and the second control units is further adapted to provide control signals for the combined use of the driving means of the first and second channels. Accordingly, the present invention relates specifically to the provision of different control units, which are adapted to be independently used for more than one driving portions, although they are basically provided to drive only a single driving portion. This aspect of the present invention is e.g. beneficial for control units being implemented as hard-wired logic circuitry such as state-machines or other hard-wired logic. Based on the configurability of the electronic device according to the present invention shared and flexible use of one control unit is possible.

Another aspect of the present invention provides that the electronic device includes a first gate driver and a second gate driver, and a first and second power transistor in the driving portions. The configuration means are adapted to enable the first gate driver to drive the first and second power transistors. Accordingly, a specific gate driver out of a plurality of gate drivers, each of which is dedicated to a single channel of light emitting diodes, can be used to drive a plurality of power transistors or switches.

According to still another aspect of the present invention, the first driving portion includes a high side driver and a low side driver, and the second driving portion comprises a high side driver and a low side driver, too. Accordingly, the present invention relates also to configurations having high side and low side drivers instead of a single driving device like a switch or a transistor. According to this aspect of the present invention, the high side and low side drivers of a specific first channel are used in a combined manner with the high side and low side drivers of a second channel to drive a single string of light emitting diodes instead of two strings of light emitting diodes.

According to an aspect of the present invention, the electronic device includes a first bypass switch and a second bypass switch and a first pulse width modulation unit and a second pulse width modulation unit for the first and second driving portions, respectively. In this situation, the configuration means are adapted to enable the first pulse width modulation unit to provide appropriate signals for the first and second driving portion. Usually, the pulse width modulation units are limited to provide a specific signal for only one bypass switch. The present invention provides further that a single pulse width modulation unit is used to provide signals to multiple bypass switches. These bypass switches may be used for a single or multiple strings of light emitting diodes. According to the present invention, the bypass switches driven by one or more pulse width modulation units can be used in serial or in parallel for one or more strings of light emitting diodes. Since one or more components of the electronic device are shared between at least two channels, the chip area can be more efficiently used. This is mainly due to the fact that the switch transistors or power transistors usually consume a considerable amount of chip area. The different units and portions of the electronic device are enabled by the configuration means to be coupled to multiple portions such as driver switches or power transistors belonging to other channels of the electronic device resulting in a more efficient use of the specific electronic components. Further, the present invention provides a higher configurability and applicability of a specific electronic device to a new and broader variety of applications.

According to aspects of the present invention, the control units and gate drivers of the electronic device are configurable to provide appropriate switching sequences for either a single string of light emitting diodes, or for multiple strings of light emitting diodes. According to a specific aspect of the present invention, the electronic device includes further a break-before-make unit to avoid inadmissible simultaneous turn-on of the high side and low side switches of a specific channel. Accordingly, the electronic device includes means to avoid inadmissible switching sequences for the switching devices, thereby reducing the requirements for the control units and the configurability of the electronic device. An optimum timing of turning the switches on and off is provided by simultaneous switching. However, practically, one switch is turned off first, and the other switch is turned on a small amount of time later. This provides a certain amount of time between the two switching activities, thereby ensuring that the two switches are not turned on at the same time. Accordingly, watch dog units, such as the break-before-make unit mentioned above can be provided in the electronic device to assure appropriate activation of switches or power transistors.

According to a further aspect of the present invention, the first driving portion and the second driving portion include at least a first switch and a second switch and a first gate driver and a second gate driver for each switch, respectively. The control unit can be coupled to both gate drivers in order to control the switches by the gate drivers to enable the combined use of the switches for a single channel. Accordingly, the chip area usually consumed by the switches is efficiently used as the control unit is adapted to be coupled to both or all gate drivers of multiple driving portions of the integrated circuit in order to provide control signals to the gate drivers. The gate drivers are used to switch the multiple switches such that they provide appropriate switching sequences for single string of LEDs, though each driving portion is also adapted to supply one string of LEDs alone.

According to an aspect of the present invention, the electronic device further includes a pin to be coupled to an LED or a string of LEDs. The pin (e.g. on a package of an IC) is configurable to provide a current to an LED or a string of LEDs, and, additionally, the pin is configurable to be used in combination with another pin of the electronic device of the same type for the LED or the string of LEDs This aspect of the present invention relates to the improved configurability of the electronic device, which provides pins, such as input and output pins, which are configurable to be used in a combined manner with other pins of the device. Further, an input pin may be provided which is configurable to receive a sensing signal of LED or a string of LEDs which is driven by the combined power of more than one channel.

BRIEF DESCRIPTION OF THE DRAWINGS

These and other aspects of the invention will be apparent from and elucidated with reference to the embodiments described hereinafter. In the following drawings.

DETAILED DESCRIPTION OF THE EMBODIMENTS

Figure 1:
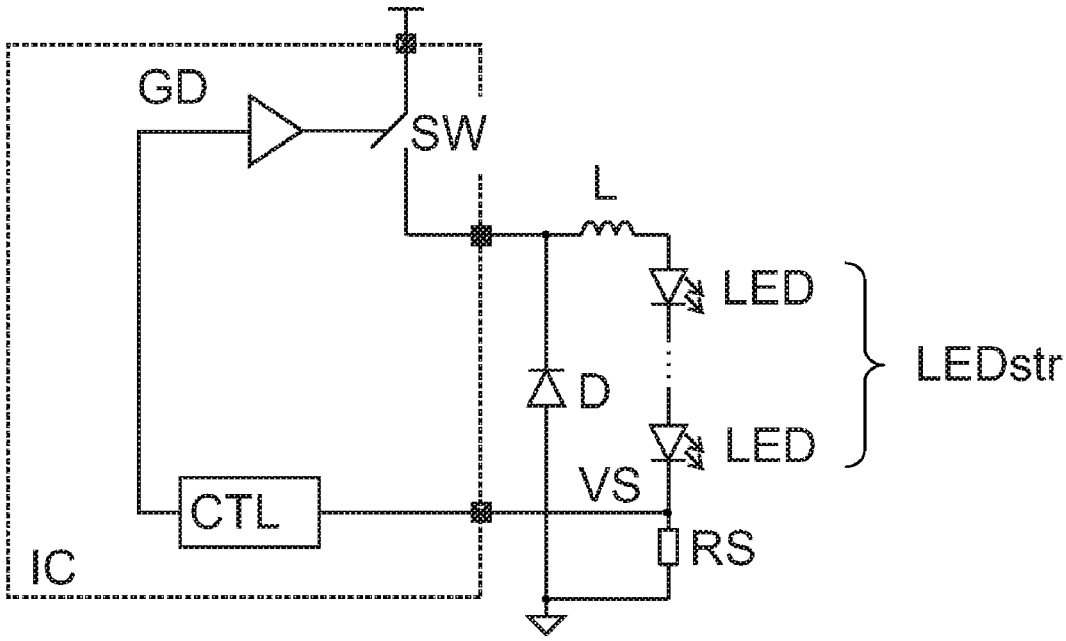
FIG. 1 shows a simplified schematic of a conventional switch mode driving device.

FIG. 1 shows a simplified schematic of a down converter according to the prior art. The conventional down converter includes an internal high side switching device SW, a gate driver GD for the switching device SW, and a control logic CTL being coupled to drive a string LEDstr consisting of a plurality of light emitting diodes LED. The gate driver GD, the switching device SW, and the control logic CTL are usually provided on a single integrated circuit IC. Further, there is an external fly-back diode D and an inductor L and a means to sense the current, as e.g. a sense resistor RS. In the shown configuration the control logic CTL is adapted to provide a fixed frequency, a hysteretic or a self oscillating driving signal to the gate driver GD. The gate driver GD controls the switching device SW, which is typically a transistor. The control logic CTL receives a sensing value, in this example a sensing voltage VS, which is representative of the current through the string of light emitting diodes. In response to this signal, the control unit provides a control signal to adapt the current appropriately in order to provide a constant color and intensity of light.

Figure 2:
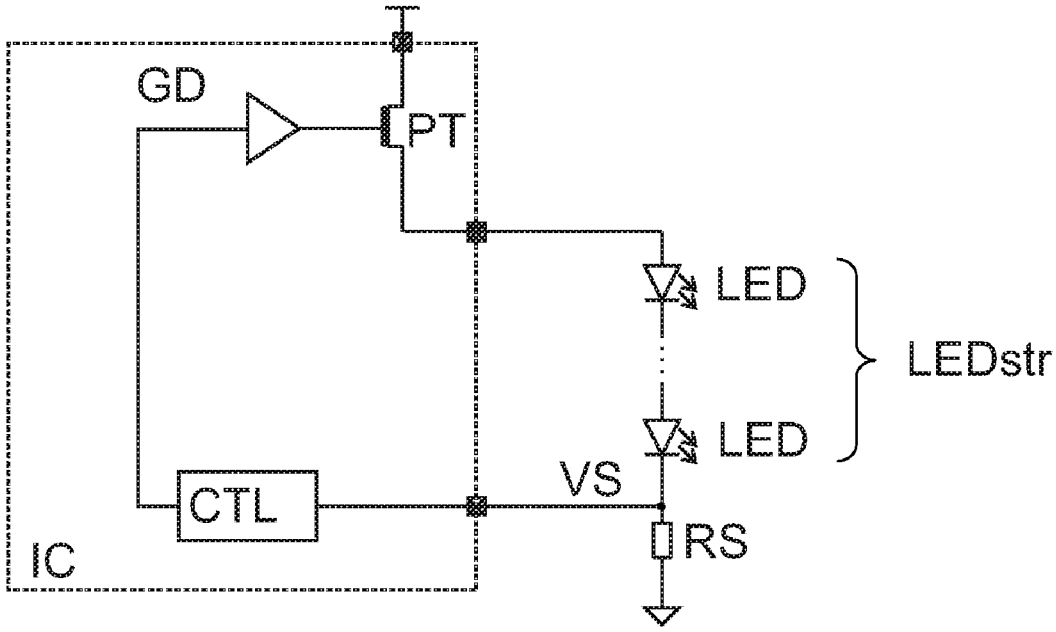
FIG. 2 shows a simplified schematic of a conventional linear driving device.

FIG. 2 shows a simplified schematic of a linear driver type according to the prior art, which is also susceptible to be improved by the present invention. The power transistor PT is driven by a gate driver GD, which is typically an operational amplifier or similar means to provide a basically linearly controlled gate signal to the device. The control is implemented by control circuit CTL, which operates in response to a sensing voltage measured across sensing resistor RS representing the current through the LED string LEDstr. Further, the control unit CTL receives a sensing voltage VS in order to adapt the current through the string of light emitting diodes LEDstr appropriately.

The present invention is advantageous and applicable to both, linear configurations and switched configuration as shown in FIG. 1 and FIG. 2. Irrespective of whether the invention is explained based on a preferred embodiment which relates rather to a switch mode configuration or rather to a linear driver, the aspects explained herein are meant to be similarly applicable to the respective other way of driving a device.

Figure 3:
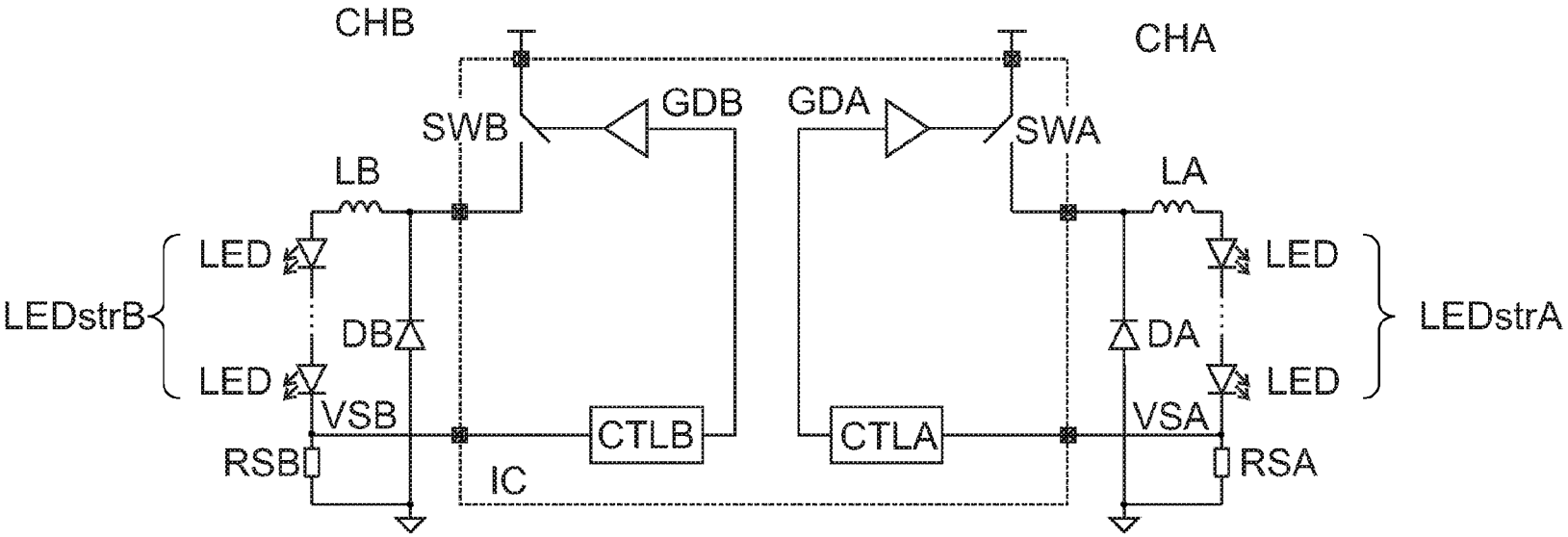
FIG. 3 shows a simplified schematic of a conventional switched mode driving device with two channels.

FIG. 3 shows a simplified schematic of a conventional down converter with two channels. Accordingly, there are two similar configurations to the one shown in FIG. 1. The integrated circuit IC, which is indicated by a dashed line, includes two channels CHA and CHB, each of which includes a gate driver GDA, GDB, a control logic CTLA, CTLB, and high side switches SWA, SWB. Each of the two channels CHA, CHB drives a string of light emitting diodes LEDstrA, LEDstrB, respectively, which are coupled to the interface pins of the integrated circuits by external inductors LA, LB. Further, there are two flyback diodes DA, DB, and one sense resistors RSA, RSB per channel. Accordingly, FIG. 2 shows the conventional principal of driving two strings of light emitting diodes LEDstrA, LEDstrB in series by two separate channels CHA, CHB of a driver circuit IC. The control units CTLA, CTLB are adapted to control the currents through the strings of light emitting diodes LEDstrA, LEDstrB in response to the sensing voltages VSA and VSB. A similar configuration as the one shown in FIG. 3 can be implemented by linear drivers as shown in FIG. 2.

Figure 4:
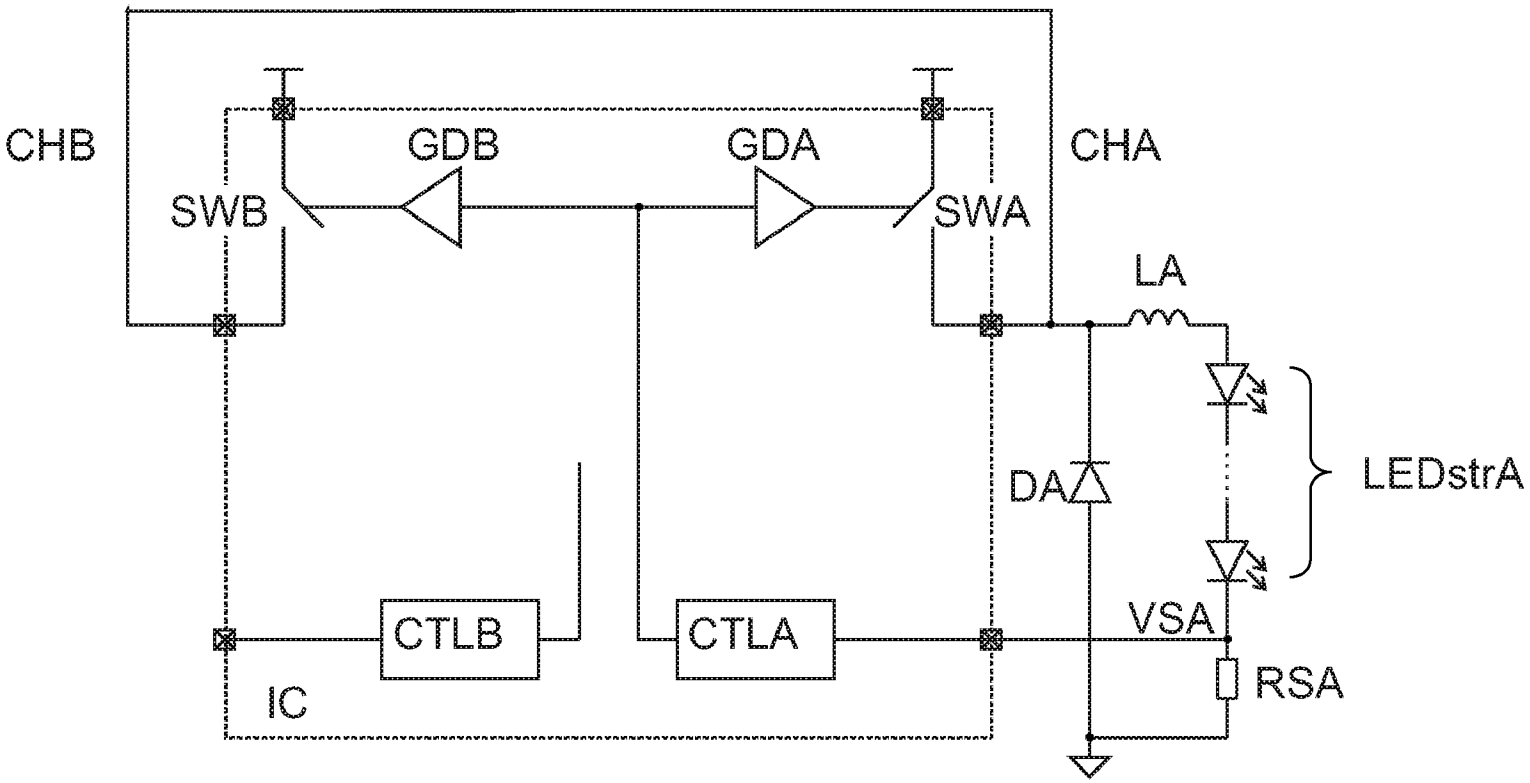
FIG. 4 shows a simplified schematic of a first embodiment according to an aspect of the present invention.

FIG. 4 shows a simplified schematic of a configuration according to a first embodiment of the present invention. According to this aspect of the invention, the components provided on an integrated circuit IC are adapted to be more efficiently used. In particular, the control logic CTLA, CTLB of at least one of at least two channels CHA, CHB on the integrated circuits—i.e. either CTLA or CTLB or both—are configurable to use the combined output powers of the two channels CHA and CHB. Accordingly, the electronic device shown in FIG. 4 provides configuration means, such that the second high side switch SWB can be coupled to the output of the first high side switch SWA. The two switches are driven by the two gate drivers GDA and GDB, respectively. The first control logic CTLA is coupled to both gate drivers GDA and GDB. The second control logic CTLB remains idle. The output of the control logic CTLB may be e.g. floating, in a tri-state high impedance mode, or terminated by an appropriate device. Accordingly, the integrated circuit IC, in particular control logic CTLA, is adapted to provide means to control both gate drivers GDA, and GDB. The gate drivers GDA, GDB may be driven synchronously or in a particular relation to each other, such that one string of light emitting diodes LEDstrA can be driven by the combined output power provided through the two switching devices SWA and SWB. The sense resistor RSA provides an appropriate feedback signal for the first control logic CTLA such that the power to drive the LED series LEDstrA may substantially receive two times the power of one channel. Typically, the control logic CTLA is provided with reference signals to be compared to the measured sense signals. This applies similarly to all embodiments according to the present invention as described here above and here below. According to this aspect of the present invention, it is possible to provide one channel with a higher output power, if one of the channels is not used, or to provide a channel that can be driven at a higher current rating or with a higher efficiency. In order to be adaptable to this configuration, the integrated circuit IC provides configuration means as, for example, a programming bit or a multiplexer being switched by an external signal or an internal signal, in order to provide either two independent channels CHA, CHB, or one combined channel. Further, according to another aspect of the present invention, the two channels CHA, CHB of the configuration shown in FIG. 3 may be classified as master and slave. Accordingly, the first channel CHA may serve as the master channel, whereas the other channel(s) CHB may be used as slave channel(s). Further, the control unit CTLA is adapted to provide the control signals in response to the sensing voltage VSA. As the string of light emitting diodes is driven by the combined driving portions of the first and the second channel, the control unit is to be adapted appropriately to respond to the sensing voltage VSA.

Figure 5:
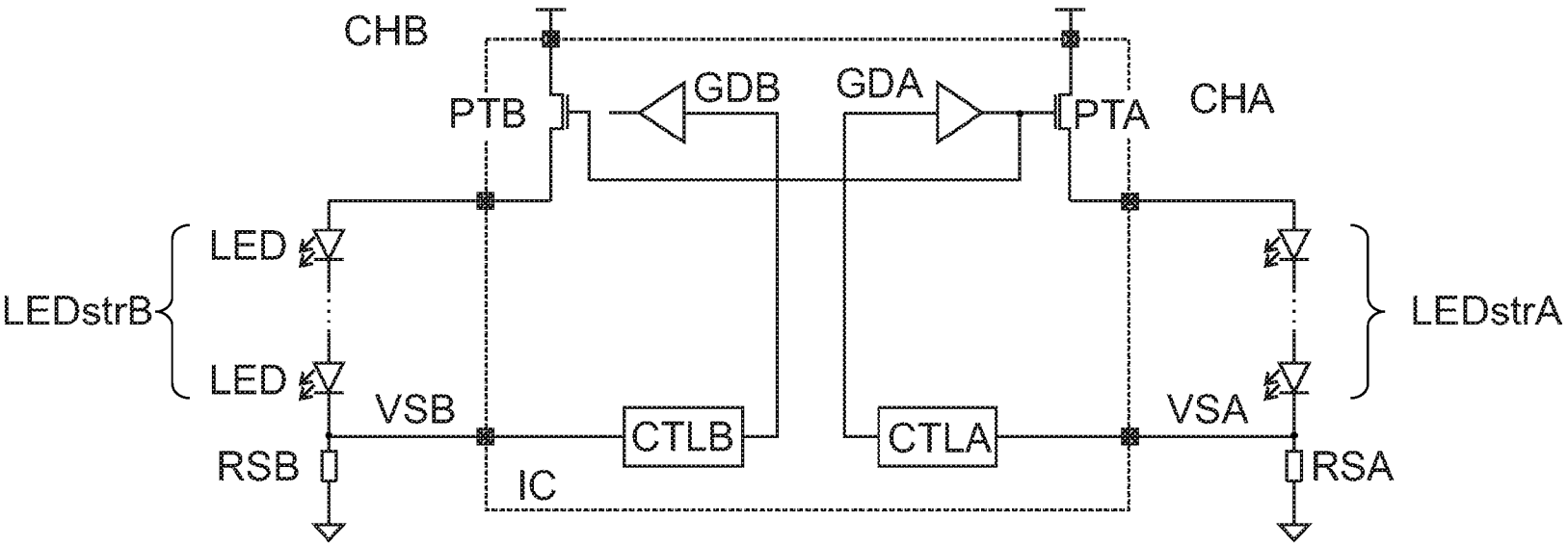
FIG. 5 shows a simplified schematic of a second embodiment according to an aspect of the present invention.

FIG. 5 shows a simplified schematic of an embodiment according to an aspect of the present invention. FIG. 5 shows a configuration for linear drivers with one power transistor PTA, PTB per channel CHA, CHB, respectively. Further, there are two gate drivers GDA and GDB for driving the power transistors PTA and PTB, respectively. Each of the driving portions relating to either channel A or channel B is basically configured to drive a single string of LEDs LEDstrA and LEDstrB. According to an aspect of the present invention, configuration means are provided, such that the control logic CTLA can be configured to drive the gate driver GDA, which is basically a linear device like an operational amplifier, to drive both power transistors PTA and PTB. The control logic CTLA receives two sensing values across resistors RSA and RSB and provides a corresponding driving signal to the gate driver GDA. The gate driver GDB is idle in this configuration. Accordingly, the control logic CTLA is configurable to drive two strings of light emitting diodes LEDstrA, LEDstrB by use of the two power transistors PTA and PTB. The same principle to use one control logic for two channels can be applied to switched mode driving circuits. The control unit CTLA responds to the single sensing voltage VSA, which is provided by the first string of light emitting diodes LEDstrA. Therefore, the control mechanism is based on the current through LED string A instead of two sensing voltages being provided by LEDstrA and LEDstrB. In order to save power, the second control unit CTLB and the second gate driver GDB may be switched off. Alternatively, the outputs of the control unit or the gate driver may be pulled up, pulled down, or put in tri-state. According to a specific aspect of the present invention, the gate driver is configurable to provide a sufficient driving capability for the different configurations. As a combination of several switches (several gates of, for example, MOSFET transistors) increases the capacitive load for the gate driver, it is necessary to adapt the gate driver's driving capability appropriately. Such a configurability can be provided within the gate driver, for example, by a gain-determining resistor in the gate driver circuit, which is changed based on the different configurations. The gain-determining resistor may be changed by a switch or multiple switches controlled by the CTLA block. Another possibility to adapt the driving properties of the gate driver consists in adapting a bias current for the differential input stage of a gate driving circuitry. The configuration means according to the present invention include and provide all aspects of configurability according to the present invention.

Figure 6:
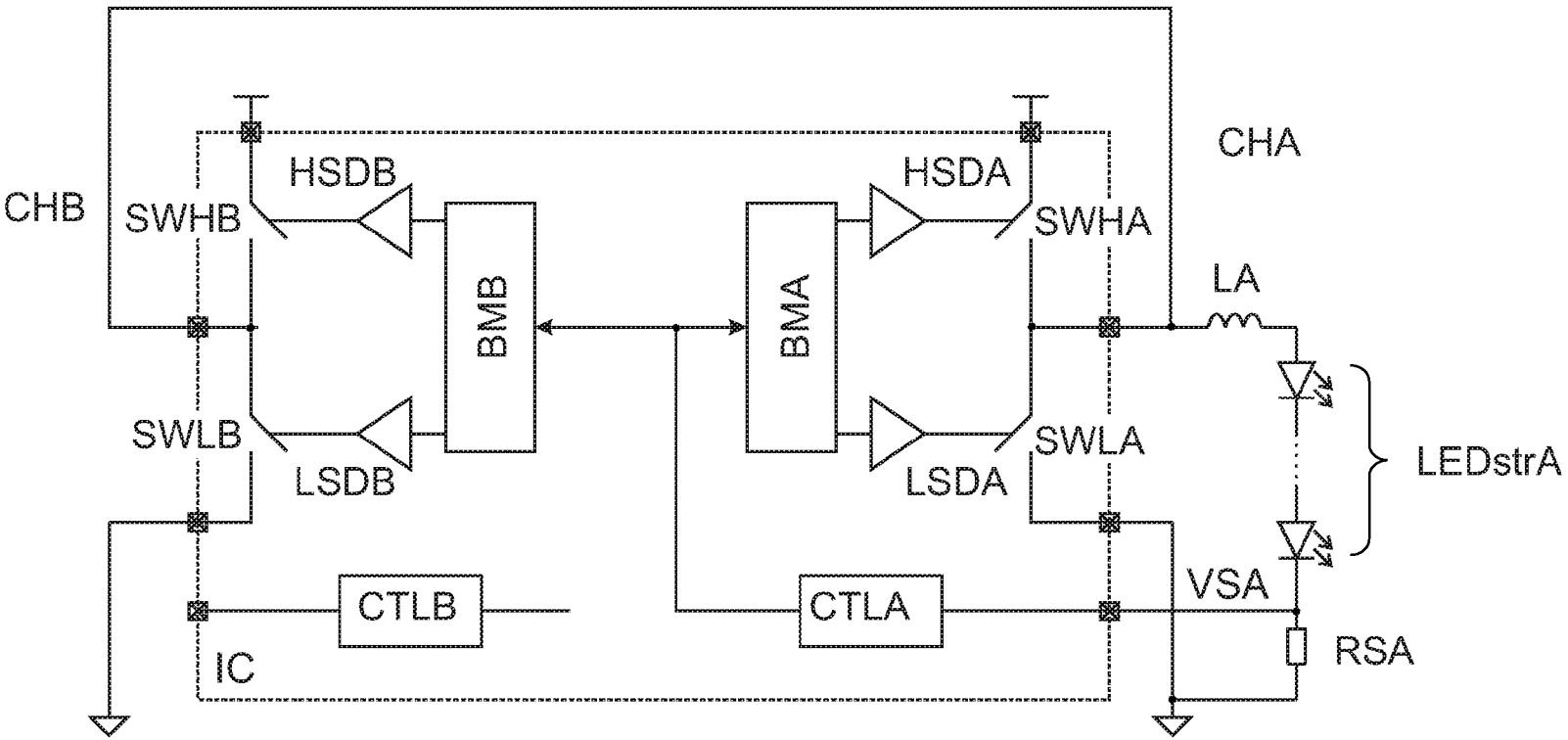
FIG. 6 shows a simplified schematic of a third embodiment according to an aspect of the present invention.

FIG. 6 shows a simplified schematic of an embodiment according to an aspect of the present invention. Accordingly, there are two channels CHA and CHB provided in an integrated circuit IC. The integrated circuit IC is indicated by a dashed line. However, other and additional components may be included in the IC without departing from the basic idea of the present invention. Each of the channels CHA, CHB provides a high side driver HSDA, HSDB, and a low side driver LSDA, LSDB, respectively. The drivers are coupled to corresponding switches SWHA, SWHB, SWLA, SWLB being used to switch the power for a string of light emitting diodes LEDstrA, LEDstrB in series in response to the signals provided by the two control logic blocks CTLA, CTLB. In addition, the present circuit provides two break-before-make circuits BMA and BMB. The break-before-make circuits BMA and BMB provide means to prevent that the power devices SWHA and SSWLA as well as the power devices SWHB and SWLB are switched on, simultaneously. Switching on the high side and the low side switches at the same time would result in undesired cross currents through the switches. The circuitry shown in FIG. 6 provides a control logic CTLA being adapted to allow the combination of the driving devices, such as SWHA, SWLA, SWHB, SWLB for a single string of light emitting diodes LEDstrA. The control unit CTLA must be appropriately configured to receive only the sensing voltage VSA to control the string of light emitting diodes which is driven by both driving portions. The driving portions include the break-before-make units BMA and BMB, high side drivers HSDA and HSDB, and low side drivers LSDA and LSDB. The second control unit CTLB can be disabled in order to save power.

Figure 7:
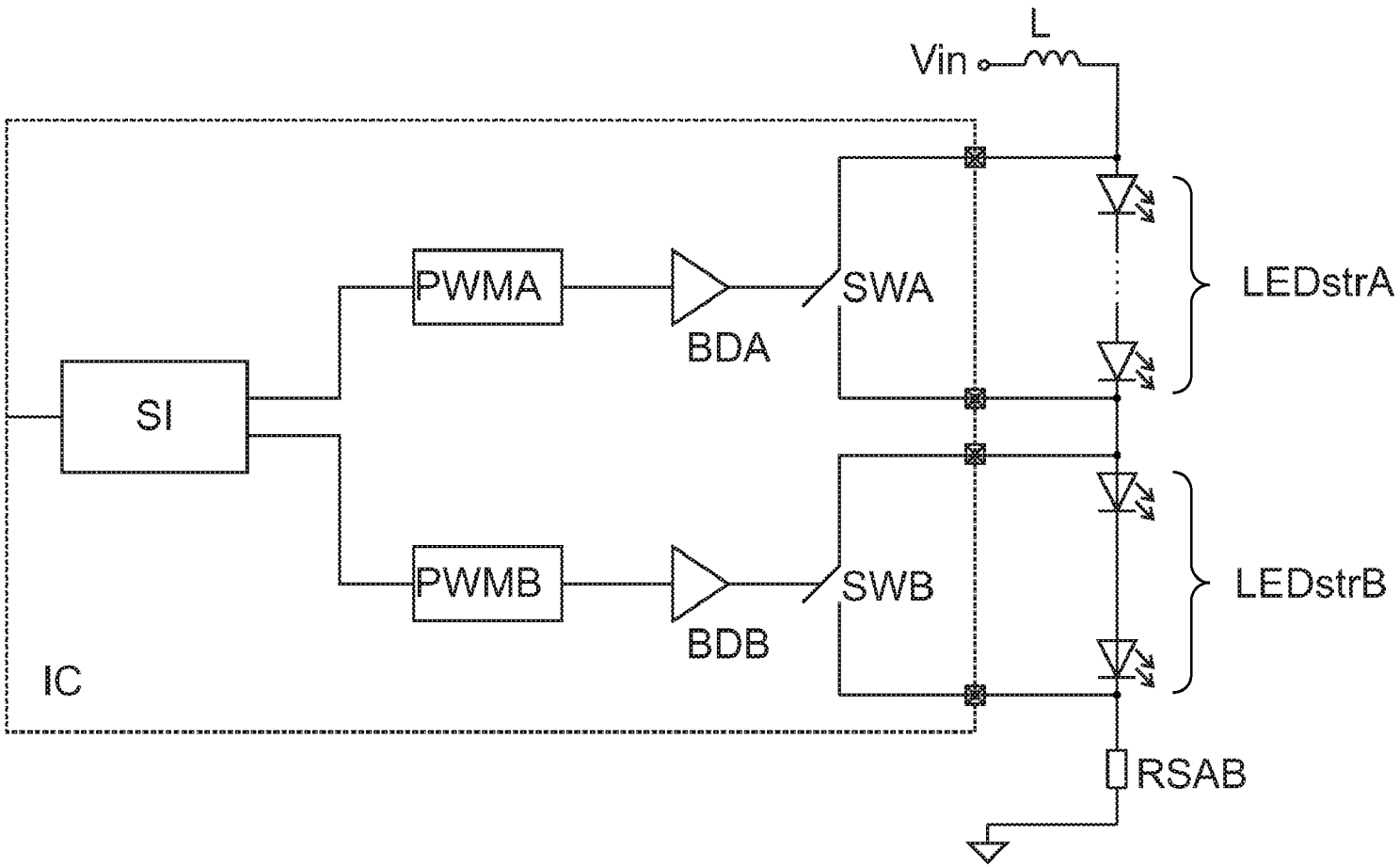
FIG. 7 shows a simplified schematic of a schematic of a conventional principle of using two channels in one LED string.

FIG. 7 shows a simplified schematic of a conventional driver circuit according, which is configured to control a first portion LEDstrA of a string of LEDs and a second portion LEDstrB of a string of LEDs. The portions LEDstrA and LEDstrB are coupled in series to form a single string wherein the two portions are controlled separately. Via the serial interface SI the pulse width modulating units PWMA, PWMB receive control signals to provide appropriate signals to the bypass drivers BDA, BDB. Bypass driver BDA controls a switch SWA in order to bypass the series of light emitting diodes LEDstrA, and bypass driver BDB controls a switch SWB to bypass string LEDstrB. The control mechanism for controlling the current through the LED strings LEDstrA and LEDstrB is based on a sensing voltage being derived from the voltage across the sensing device RSAB.

Figure 8:
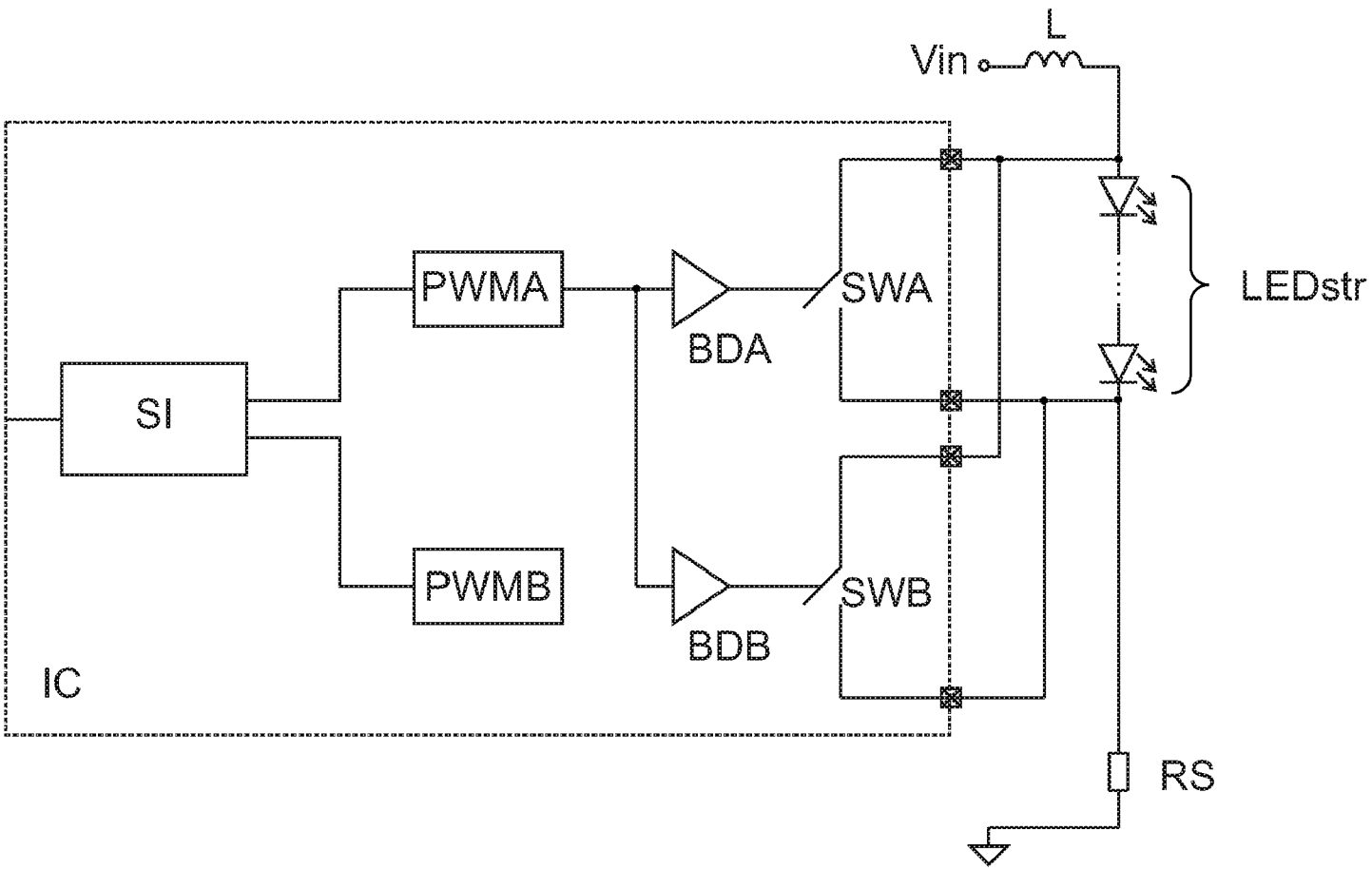
FIG. 8 shows a simplified schematic of an embodiment according to an aspect of the present invention of combining two channels.

FIG. 8 shows a simplified schematic of a configuration according to an aspect of the present invention relating to FIG. 7. Accordingly, a first pulse width modulating unit PWMA is coupled to the two bypass drivers BDA and BDB. The electronic device of FIG. 8 provides configurability to use the drivers BDA, BDB and the switches SWA, SWB more effectively for a single string of LEDs, LEDstr. The two configurations of either two independent channels or one combined channel are implemented in the integrated circuit IC by a programmable bit, register, any storing means or a multiplexer, or the like. The commands to provide appropriate pulse width modulated signals are received by a serial interface SI. The electronic device is further configurable to provide a single pulse width output signal PWMA to both of the bypass drivers BDA and BDB. Accordingly, the switches SWA and SWB are substantially synchronously switched on and off. Accordingly, it is possible to combine multiple channels in order to provide one channel with higher output power. The control of the current through the LED string LEDstr is now based on a sensing voltage across the sensing resistor RS. The pulse width modulation unit PWMB can be disabled in order to save power. Disabling of the units includes putting the outputs or inputs in a specific state, such as pulling up or pulling down or setting the outputs in tri-state.

According to the above aspects of the present invention, a integrated electronic device may be provided having input and output pins being configured to provide the above described functionality. Accordingly, the present invention also relates to an electronic device having input and/or output pins for being coupled to LEDs, which provide functionality relating to one or more of the above mentioned aspects of the invention.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. In particular, a single LED may be replaced by a string of LEDs, and a single switch or driver may be replaced by several switches or drivers respectively, without departing from the scope of the present invention. The mere fact that certain measures are recited in mutually different dependent claims does not indicate that a combination of these measured cannot be used to advantage. Any reference signs in the claims should not be construed as limiting the scope.

The invention claimed is:

1. An electronic device for driving at least a first channel and a second channel of light emitting diodes, the electronic device comprising:

a first and a second driving portion for driving the first and the second channel of light emitting diodes separately, and a first control unit being adapted to provide control signals for the first driving portion; and a second control unit to provide control signals for the second driving portion, the first control unit to provide control signals to the first and the second driving portion to enable the shared use of at least parts of the first and second driving portions.

2. The electronic device according to claim 1, further comprising a pin to be coupled to one or more light emitting diodes, the pin being configurable to provide a current to the one or more light emitting diodes, wherein the pin is further configurable to be used in combination with a another pin of the electronic device of the same type for the one or more light emitting diodes.

3. An electronic device for driving at least a first channel and a second channel of light emitting diodes, the electronic device comprising:

first and second driving portions respectively configured and arranged to drive the first and the second channel of light emitting diodes separately, a first control unit configured and arranged to provide control signals for the first driving portion, and to provide control signals to the first and second driving portions to share at least parts of the first and second driving portions for respectively driving the first and second channels of light emitting diodes; and a second control unit configured and arranged to provide control signals for the second driving portion and to at least partially disable when the first control unit is used to control the first and second driving portions.

4. The electronic device according to claim 3, wherein the first control unit receives a sensing signal from a first string of light emitting diodes being coupled to the first and second driving portions.

5. The electronic device according to claim 4, wherein a first switch and a second switch are used as drivers, and wherein the first and the second switch are used in combination for one channel of light emitting diodes.

6. The electronic device according to claim 4, wherein a first power transistor and a second power transistor are used as drivers, and wherein the first power transistor and the second power transistor are used in combination for one channel of light emitting diodes.

7. The electronic device according to claim 6, wherein the first control unit and second control unit provide control signals for the first and the second driving portion, respectively, wherein the first control unit is adapted to provide control signals for the combined use of driving the first and second channel.

8. The electronic device according to claim 7, wherein a first gate driver and a second gate driver drive the first power transistor and the second power transistor, wherein the first gate driver drives the first and the second power transistors.

9. The electronic device according to claim 4, wherein the first driving portion comprises a high side driver and a low side driver, and the second driving portion comprises a high side driver and a low side driver, the second driving portion using the high side driver and low side driver wherein the high side driver and low side driver of the first driving portion are used to drive a single string of light emitting diodes.

10. The electronic device according to claim 9, further comprising a break-before-make unit to avoid inadmissible simultaneous switching of the high side and low side switches of a channel.

11. An electronic device for driving at least a first channel and a second channel of light emitting diodes, the electronic device comprising:

first and second driving portions respectively configured and arranged to drive the first and the second channel of light emitting diodes separately, the first driving portion including a first bypass switch and a second bypass switch, and a first pulse width modulation unit and a second pulse width modulation unit for the first and the second driving portion, respectively, the first pulse width modulation unit being configured and arranged to provide signals for the first and the second driving portions, a first control unit configured and arranged to provide control signals for the first driving portion, and to provide control signals to the first and second driving portions to share at least parts of the first and second driving portions for respectively driving the first and second channels of light emitting diodes; and a second control unit configured and arranged to provide control signals for the second driving portion.

12. The electronic device according to one claim 11, wherein the first and second driving portions are used in parallel for a string of light emitting diodes.

13. The electronic device according to one claim 11, wherein the first and second driving portions are used in series for a string of light emitting diodes.

* * * * *